US005669237A

United States Patent [19]

Voit

[11] Patent Number: 5,669,237

[45] Date of Patent: Sep. 23, 1997

[54] METHOD AND APPARATUS FOR THE LOW-TEMPERATURE FRACTIONATION OF AIR

[75] Inventor: Jürgen Voit, Schondorf, Germany

[73] Assignee: Linde Aktiengesellschaft, Hoellriegelskreuth, Germany

[21] Appl. No.: 614,974

[22] Filed: Mar. 11, 1996

[30] Foreign Application Priority Data

| | | | |
|---|---|---|---|
| Mar. 10, 1995 | [DE] | Germany | 195 08 759.3 |
| Jun. 1, 1995 | [DE] | Germany | 195 20 196.5 |
| Jun. 1, 1995 | [DE] | Germany | 195 20 198.1 |

[51] Int. Cl.[6] ..... F25J 3/04

[52] U.S. Cl. ..... 62/646; 62/647

[58] Field of Search ..... 62/643, 644, 645, 62/646, 647

[56] References Cited

U.S. PATENT DOCUMENTS

| | | | |
|---|---|---|---|
| 4,704,148 | 11/1987 | Kleinberg | 62/646 |
| 5,006,137 | 4/1991 | Agrawal et al. | 62/646 |
| 5,251,451 | 10/1993 | Xu et al. | 62/646 |
| 5,349,824 | 9/1994 | Ha et al. | 62/646 |
| 5,361,590 | 11/1994 | Rathbone | 62/646 |
| 5,392,609 | 2/1995 | Girault et al. | 62/646 |
| 5,396,773 | 3/1995 | Ha et al. | 62/646 |
| 5,438,835 | 8/1995 | Rathbone | 62/646 |
| 5,485,729 | 1/1996 | Higginbotham | 62/646 |
| 5,551,258 | 9/1996 | Rathbone | 62/646 |

*Primary Examiner*—Christopher Kilner

*Attorney, Agent, or Firm*—Evenson McKeown Edwards & Lenahan PLLC

[57] ABSTRACT

For the method, air (103, 104) is fractionated in a medium-pressure column (6) and a low-pressure column (5). The sump heating (3) of the low-pressure column (5) is carried out with a second airflow (204), which is liquefied at the same time. An intermediate fraction (18) is taken from the low-pressure column (5) and evaporated in the head condenser (10) of the medium-pressure column (6). The thereby resulting vapor (19) is returned to the low-pressure column. In the event that impure oxygen is obtained, the second airflow (203, 204) is recompressed (202) upstream from the sump heating (3), external energy being supplied, to a pressure above that of the medium-pressure column, the pressure being relieved downstream from the sump heating (3) in a first pressure relief valve (208) to the pressure of the medium-pressure column (6). If pure oxygen is recovered, the sump heating of the low-pressure column is operated with an airflow, which at the same time is condensed at least partially and is under a pressure, which is less than the pressure of the medium-pressure column. If oxygen of high and low purity is to be recovered, a portion of the evaporated first intermediate fraction and/or a fraction obtained below the second intermediate site are recovered from the low-pressure column as oxygen product of lower purity.

27 Claims, 8 Drawing Sheets

10
9
208
205a
104
402
11
6
7
12
19
18
4
7a
16
13
205
17
20
8
15
LOX
5
412
411
3
413
410
14
401
204
2
307
COX
Rest
16a
203
103
305
104
30a
306
Luft
16b
201
202
30c
30b
31
KT
H2O
32
ATM

METHOD AND APPARATUS FOR THE LOW-TEMPERATURE FRACTIONATION OF AIR

BACKGROUND AND SUMMARY OF THE INVENTION

The invention relates to a method for recovering oxygen by the low-temperature fractionation of air in a double column said method comprising forming a first airflow and a second airflow and compressing same to a first pressure, passing the first airflow into a medium-pressure column, which is operated at above atmospheric pressure and in which an oxygen-enriched sump liquid and a first nitrogen-rich fraction are obtained, passing the sump liquid at a first intermediate site into a low-pressure column, which is operated under a pressure lower than that of the medium-pressure column, condensing the first nitrogen-rich fraction at least partially by indirect heat exchange, a nitrogen-rich liquid being produced, using a first portion of the nitrogen-rich liquid as backflow in the medium-pressure column, using a second portion of the nitrogen-rich liquid as backflow in the low-pressure column, obtaining a second nitrogen-rich fraction at the head of the low-pressure column and obtaining an oxygen-rich liquid in the sump of the low-pressure column, evaporating the oxygen-rich liquid at least partially by indirect heat exchange in a heat exchanger, carrying out the indirect heat exchange for evaporating the oxygen-rich liquid against the second airflow, which is condensed at least partially at the same time, using at least a portion of the evaporated, oxygen-rich liquid as rising vapor in the low-pressure column, drawing off a different portion of the evaporated, oxygen-rich liquid and/or a portion of the oxygen-rich liquid as oxygen products, evaporating a first liquid intermediate fraction, which is obtained in the low-pressure column at a second intermediate site, at least partially by the indirect heat exchanged for condensing the first nitrogen-rich fraction, and using at least a portion of the evaporated first intermediate fraction as rising vapor in the low-pressure column.

The known Linde method (Hausen/Linde, Tiefiemperaturtechnik (Low-Temperature Technology), 2nd edition 1985, page 326) represents a double-column method with a pressure column and a low-pressure column, the air being fed in the gaseous state into the pressure column. It is distinguished by the fact that the head condenser of the pressure column and the sump heater of the low-pressure column are combined into a condenser/evaporator. This permits a generally particularly compact construction and an easily controlled method. However, a certain minimum air pressure is fixed by the vapor pressure curves of the head fraction of the pressure column and of the sump fraction of the low-pressure column.

For the double-column methods with a medium-pressure column and a low-pressure column of U.S. Pat. No. 3,210,851 and EP-A-381319, it was therefore proposed that the low-pressure column be heated with air at the pressure of the medium-pressure column and the medium-pressure column be cooled by evaporation of an intermediate fraction from the low-pressure column. With that, the pressure in the medium-pressure column can be reduced within certain limits.

It is an object of the invention to further improve the efficiency of this method and of the corresponding apparatus.

Pursuant to the invention, this objective is accomplished by three variations, each of which is adapted to specific purity requirements of the oxygen product or products.

The first variation of the invention relates to a method, with which oxygen of average or lesser purity is obtained in the sump of the low-pressure column. The above-mentioned objective is accomplished by providing a method of the above-mentioned type, wherein the second airflow is recompressed with addition of external energy to a second pressure, which is higher than the first pressure, upstream from the direct heat exchanger for evaporating the oxygen-rich liquid an wherein the pressure on the second airflow is relieved at least partially in a pressure relief valve to a pressure approximately that of the medium-pressure column downstream of the indirect heat exchanger for evaporating the oxygen-rich liquid.

The first and second airflows initially are compressed in parallel or preferably together to a first pressure, which is comparatively low for the inventive method and is sufficient, for example, to push the first airflow into the medium-pressure column, pressure losses in the pipelines, heat exchangers and the like being taken into consideration. Only the second airflow is recompressed by an externally driven compressor to an appreciably higher pressure and supplied to the condenser/evaporator for heating the sump of the low-pressure column by indirect heat exchange. In heating the sump of the low-pressure column, the second airflow is largely condensed and preferably completely condensed.

The cost of the compressor equipment is particularly low if the first and second airflows are compressed jointly to the first pressure and the first airflow, downstream from where the second airflow branches off, is fed into the medium-pressure column without further measures for changing the pressure. The first pressure is then essentially equal to the pressure of the medium-pressure column (plus losses in the pipeline).

With respect to its pressure, the medium-pressure column is uncoupled completely from the sump heating of the low-pressure column and can be operated at a very low pressure. Only a portion of the air used must be brought to the higher pressure, which is required for heating the low-pressure column, so that the energy consumption of the inventive method is particularly low. This is true particularly for recovering oxygen of medium or low purity (80 to 97% and preferably 90 to 95%).

In the case of the first variation, the second airflow is supplied preferably essentially completely or completely to the medium-pressure column downstream from the indirect heat exchange for evaporating the oxygen-rich fluid. In addition to or deviating from this, the second airflow can also be passed partly or completely into the low-pressure column.

The second variation relates to the production of oxygen of high purity, particularly of a purity of 98% by volume or higher, and is characterized by the distinguishing features of claim 2.

In the case of the indirect heat exchange for heating the sump of the low-pressure column, the second airflow is under a pressure, which is less than the pressure of the medium-pressure column. (The pressure difference between the site, at which the first airflow is fed into the medium-pressure column and the liquefaction side of the sump heating of the low-pressure column preferably is at least 0.5 bar and not more than 0.8 bar.) The second airflow is condensed preferably completely by the indirect exchange of heat. A condensate is thus available, which can no longer be introduced without further effort into the medium-pressure column and instead is either brought to pressure in the liquid state or cannot participate at all in the preliminary fractionation in the medium-pressure column. For the inventive method, however, the airflow must be compressed only to a relatively low pressure, so that the method requires less energy. Within the scope of the invention, it has been observed surprisingly that this advantage outweighs the disadvantages, which were to be expected on the basis of the difficulties of introducing liquid air into the medium-pressure column. Overall, the method is particularly efficient especially for oxygen products with a purity of 98% by volume or higher.

At the same time, the total air is compressed initially to a first pressure, which preferably does not exceed the pressure required for the condensation of the second airflow and which, for this variation of the invention, lies between the pressure of the low-pressure column and that of the medium-pressure column. The first airflow, which is fed into the medium-pressure column, is brought separately to the corresponding higher pressure.

At least a portion of the condensed second airflow can be brought here to a higher pressure (for example, by means of a pump or a static height) and fed into the medium-pressure column; the pressure on the possible remainder of the liquefied second airflow is then usually relieved in the low-pressure column. From the point of view of equipment, however, it is less expensive if, in the case of the inventive method of the second variation, the whole or essentially the whole second airflow is supplied to the low-pressure column after the indirect exchange of heat for evaporating the oxygen-rich liquid.

The feeding-in site preferably is at a level, which corresponds to the composition of the (completely) liquefied air, that is, above the first intermediate site, at which the sump liquid from the medium-pressure column is supplied.

A third variation of the invention, which relates to the simultaneous production of oxygen of high and medium/low purity which involves a method of the above-mentioned type wherein a portion of the evaporated first intermediate fraction and/or a fraction from the low-pressure column, obtained below the second intermediate site is/are obtained as a further oxygen product, the purity of which is lower than that of the oxygen product obtained in the form of an evaporated, oxygen-rich liquid and/;or in the form of an oxygen-rich liquid from the sump of the low-pressure column.

Pursuant to this variation of the invention, the evaporated, first intermediate fraction from the head condenser, which is obtained by the head cooling of the medium-pressure column (indirect heat exchange for condensing the first nitrogen-rich fraction), can form the further oxygen product of (relatively) low purity directly. It is split off before the evaporated intermediate fraction is fed into the low-pressure column and/or taken directly from the low-pressure column at the site, at which the evaporated intermediate fraction is fed in. The removal of vapor does not result in any interference with the rectification in the low-pressure column, since a larger amount of vapor is supplied in the form of the evaporated intermediate fraction and, with that, sufficient rising vapor is available for the upper section of the low-pressure column. Alternatively, the further oxygen product can be removed from the low pressure column at a different site, which lies below the outlet of the first intermediate fraction to the head condenser of the medium-pressure column.

Depending on the purity requirements, it is advantageous to combine the third variation with one of the two first variations of the invention, particularly with the second variation.

For all variations of the inventive method, the second intermediate site, at which the intermediate fraction for cooling the head of the medium-pressure column is taken off, can be disposed above or below the first intermediate site. In both cases, the oxygen concentration on the evaporation side of the head condenser of the medium-pressure column is lower than that of the sump of the low-pressure column.

It is advantageous if the difference between the pressure of the second airflow during the indirect exchange of heat for evaporating the oxygen-rich liquid and the pressure of the first airflow being supplied to the medium-pressure column is at least 0.8 bar. This is so particularly for the first variation of the invention, for which the pressure on the condensation side of the sump heating of the low-pressure column is higher than the pressure of the first airflow being supplied to the medium-pressure column. The difference between these two pressures is, for example, 0.8 to 2.0 bar and preferably 1.0 to 1.5 bar.

The lowering of the pressure in the medium-pressure column, which is achieved by the inventive method, can be utilized particularly if the low-pressure column is operated at a pressure, which is only barely above atmospheric pressure, that is, at a pressure, which is just sufficient for removing the second nitrogen-rich fraction—optionally after passage through one or more heat exchangers—under essentially atmospheric pressure from the process and/or using it as regenerating gas in purification equipment.

Preferably, the evaporation space of the heat exchanger, in which at least partial evaporation of the oxygen-rich liquid takes place, and the lower region of the low-pressure column communicate with one another. This can be achieved owing to the fact that either the heat exchanger is installed in the low-pressure column or the evaporation space and the low-pressure column are connected with one another over one or more pipelines, which contain no pressure-changing fittings.

For the inventive method, the indirect exchange of heat between the first liquid intermediate fraction and the first nitrogen-rich fraction is preferably carried out in a heat exchanger, which is disposed outside of the low-pressure column. This first condenser/evaporator for cooling the head of the medium-pressure column, can be disposed, for example, at the upper end of the medium-pressure column. With this, it is possible to pass the evaporated, first intermediate fraction into the low-pressure column at a particularly suitable site, preferably where its composition corresponds to that of the rising vapor, that is, some theoretical plates below the site, at which the first liquid intermediate fraction is taken off.

In order to obtain the required cooling effect, it is advantageous if the pressure on a third airflow is relieved so as to perform work and if said third airflow is passed into the low-pressure column. The energy, obtained by the work-producing relief of pressure on the third airflow, can be used to compress the third partial flow upstream from the work-producing relief of pressure, so that little or none of the energy, introduced from the outside, is consumed. This compression usually starts downstream from the compression of the total air to the first pressure. However, pursuant to the invention, it has turned out to be frequently more advantageous to use this energy for compressing the air used upstream from purification equipment, for example, upstream from a molecular sieve installation. Preferably, the energy is transferred by mechanical means, for example, by mechanically coupling a pressure-relieving machine with an air compressor.

In many cases, the method can be improved further by using a third condenser/evaporator, in which a second liquid intermediate fraction, which is taken from the low-pressure column at a third intermediate site, is evaporated by indirect heat exchange. By these means, additional heat can be supplied to the low-pressure column at a medium height. The medium-pressure column can therefore be cooled with a fraction (fast intermediate fraction), the oxygen content of which is lower. Due to the lowering in temperature, which is associated therewith, the medium-pressure column can be operated under a very low pressure, so that overall particularly little pressure energy has to be expended.

The indirect exchange of heat for evaporating the second intermediate fraction can be carried out against a third airflow, which at the same time is condensed at least partially.

Preferably, when the air-heated third condenser/evaporator is used, the second intermediate site is above the first intermediate site. This results in a particularly low oxygen content in the first intermediate fraction, which makes it possible to lower the pressure in the medium-pressure column considerably. On the other hand, it is advantageous if the third intermediate site is below the first intermediate site. The evaporation of the second intermediate fraction, taken off at the third intermediate site, can be carried out against air under a pressure approximating that of the medium-pressure column, that is, under a pressure, which is sufficient for introducing the condensed third airflow subsequently into the medium-pressure column. The third airflow can be branched off from the first airflow.

Pursuant to a further embodiment of the inventive method, the third condenser/evaporator can be extended into a further column, in that an additional airflow can be passed into an additional column, which is operated under a pressure, which lies between the pressure of the low-pressure column and that of the medium-pressure column. With respect to the head cooling and the feeding in and removing of fractions, this column can be connected preferably parallel to the medium-pressure column. In particular, its head is cooled by evaporating the second intermediate fraction from the low-pressure column and its sump liquid and a portion of the liquid obtained in the head condenser are passed into the low-pressure column. The energy consumption can be reduced further by the lower pressure of the air introduced into the additional column.

It is advantageous for the inventive method if the indirect exchange of heat for evaporating the second liquid intermediate fraction is carried out in a heat exchanger, which is disposed outside of the low-pressure column. The third condenser/evaporator thus lies outside of the rectifying zone, as is also preferred for the first condenser/evaporator. With that, the evaporated intermediate fractions can be passed into the low-pressure column at a further intermediate site, which is located below its offtake in the liquid state, preferably where its composition corresponds to that of the rising vapor, that is, some theoretical plates below the intermediate site for taking off liquid.

In the event that one or more of the products are required under an elevated pressure, the pressure can be increased by internal compression in that a product stream is removed from one of the columns in the liquid state, brought to pressure in this liquid state and subsequently evaporated. In this case, a partial airflow must have a correspondingly higher pressure, in order to be able to evaporate the internally compressed product.

The inventive method can also be used for recovering argon, if an argon rectifier is connected in a known manner downstream from the low-pressure column (see, for example, EP-B-377117).

Other objects, advantages and novel features of the present invention will become apparent from the following detailed description of the invention when considered in conjunction with the accompanying drawings.

DETAILED DESCRIPTION OF THE DRAWINGS

Figure 1:
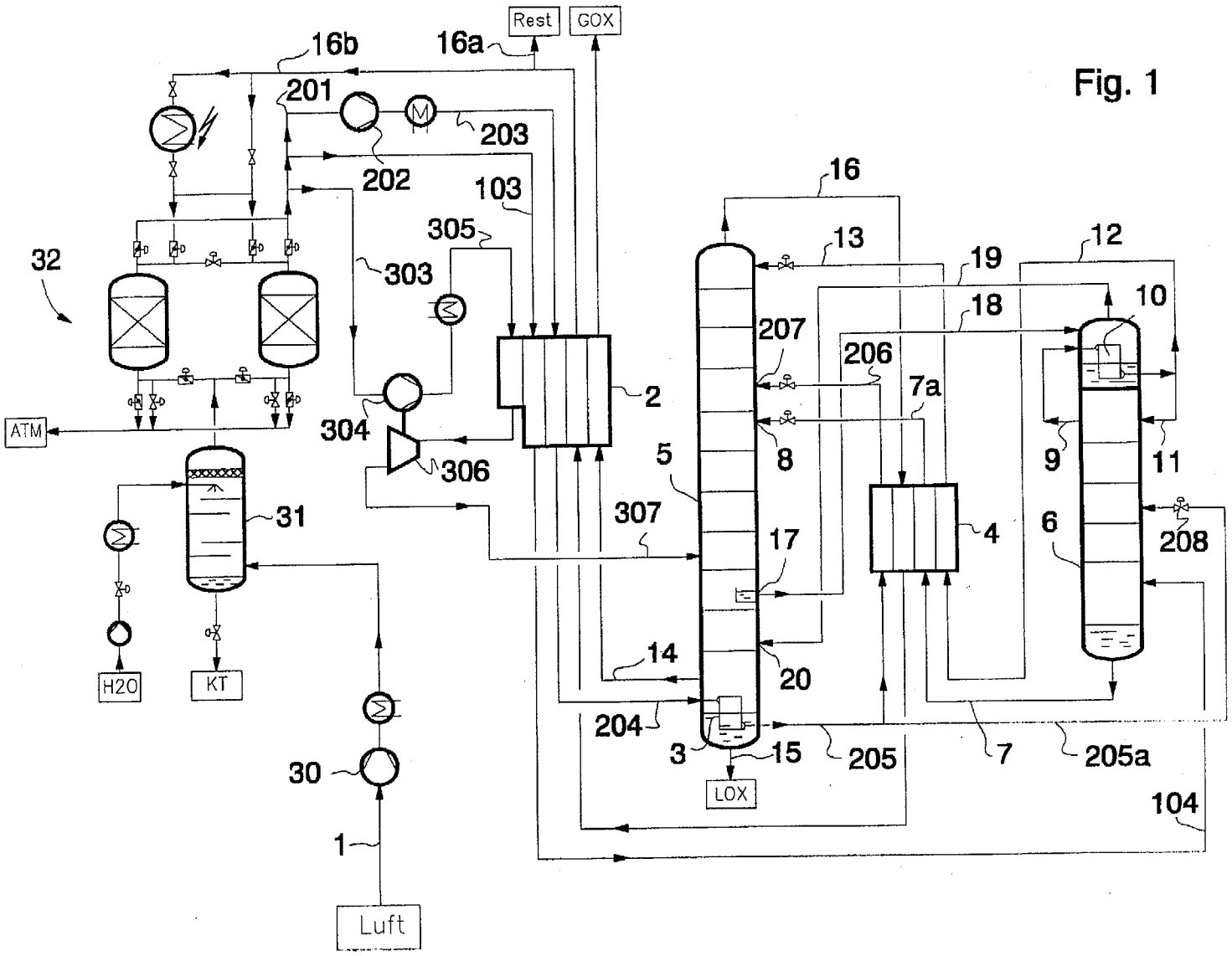
FIG. 1 shows an example of an inventive method of the first variation with two condenser/evaporators for recovering oxygen of medium purity.

In FIG. 1, the air, which is to be fractionated, is drawn in at 1 and compressed in an air compressor 30 to a first pressure, pre-cooled in a cooling unit 31 in direct contact with water, and freed in purification equipment (molecular sieve installation) 32 particularly from water and carbon dioxide. The purified air is essentially at the pressure of the medium-pressure column (plus line losses), so that a portion of the first airflow can be introduced without further pressure-increasing measures over pipeline 103 through the heat exchanger 2 and over pipeline 104 into a medium-pressure column 6. Corresponding to the respective product specifications and pressure losses, the medium-pressure column is operated under a pressure of 2 to 4 bar and preferably of about 2.5 to 3.5 bar.

The sump liquid 7 from the medium-pressure column 6 is thrust at an intermediate site 8 into a low-pressure column 5, the operating pressure of which is 1.1 to 1.5 bar, preferably 1.2 to 1.4 bar and particularly about 1.3 bar. The first nitrogen-rich fraction 9, obtained at the head of the medium-pressure column 6, is condensed in a first condenser/evaporator 10. The thereby resulting nitrogen-containing liquid is partly returned over pipeline 11 to the medium-pressure column and partly supplied over pipeline 12 to the head of the low-pressure column 5 (13).

Oxygen, with a purity of, for example, 95% by volume, is obtained as the sump product of the low-pressure column 5. Oxygen product purities particularly of 80 to 97% by volume can be achieved with the method. The oxygen product is drawn off in gaseous form over pipeline 14, warmed in the heat exchanger 2 approximately to ambient temperature and drawn off as a gaseous oxygen product. If required, a portion of the oxygen can be removed in liquid form over pipeline 15.

If the oxygen is required under an elevated pressure it can be compressed in gaseous form downstream from the main heat exchanger 2 (external compression). Alternatively, oxygen, removed in the liquid state through pipeline 15, can be brought to pressure (for example, by a pump in pipeline 15) and subsequently evaporated against air in the main heat exchanger 2 or in a subsidiary condenser. In this case, a partial stream of the second airflow 203 must have correspondingly higher pressure in order to be able to evaporate the internally compressed oxygen.

A second nitrogen-rich fraction 16 is removed from the low-pressure column 5 as a gaseous head product, used in the countercurrent unit 4, if required, for undercooling liquid streams, which are introduced into the low-pressure column 5, heated in the heat exchanger 2 against air, which is to be fractionated, and discharged, for example, as residual fraction 16*a*. A portion can be used as regenerating gas 16*b* for the purification equipment 32.

A different portion of the purified air is compressed further in a recompressor 202 by, for example, at least 0.8 bar and preferably by at least 1.0 bar and introduced into the main heat exchanger 2. The second airflow 204, which has been cooled approximately to the dew point, is liquefied at least partially and preferably completely in a second condenser/evaporator 3 in indirect heat exchange with an oxygen-rich liquid in the sump of the low-pressure column 6 under a pressure of 3.5 to 4.5 bar and preferably of 3.7 to 4.1 bar. The liquefied air 205 is passed preferably completely over pipeline 205*a* into the medium-pressure column 6 and its pressure must be adjusted correspondingly for this purpose in the pressure-relief valve 208. If desired, a portion of the air, liquefied in the sump heating unit 3, can be fed over pipeline 206 into the low-pressure column 5 (at 207) and, moreover, preferably some theoretical plates above where the sump liquid 7 from the medium-pressure column 6 is fed in (first intermediate site 8).

At a second intermediate site 17 of the low-pressure column 5, a first intermediate fraction, having an oxygen content less than that of the sump liquid of the low-pressure column, is drawn off in liquid form. If necessary, it can be delivered with the help of a pump, which is not shown, or a geodetic head. The fast intermediate fraction 18 is fed into the evaporation space of the first condenser/evaporator 10 and evaporated there against the condensing nitrogen-rich fraction 9 from the medium-pressure column 8. The evaporated intermediate fraction is drawn off over pipeline 19 and returned at a further intermediate site 20 into the low-pressure column 5. The second intermediate site 20 is, for example, level with the second intermediate site 17, but preferably is below it as shown in FIG. 1.

A different portion of the evaporated intermediate fraction 19 can be taken to the main heat exchanger 2 and drawn off as a second oxygen product of lesser purity. This is shown in examples of the third variation of the method shown in FIGS. 7 and 8.

For generating cold, a third airflow 303 is used, which is recompressed (304) and cooled in the main heat exchanger 2 to an intermediate temperature. From there, depending on the operating pressure of the purification step (see below), the pressure on the third airflow 303 is reduced from a value of 1.5 to 8 and preferably of 2 to 7 bar and particularly of about 5.0 bar in a turbine 306 to essentially the pressure of the low-pressure column and to the dew point temperature and passed over 307 into the low-pressure column at an intermediate site, which lies above the second intermediate site 17 and below the first intermediate site 8.

Figure 8:
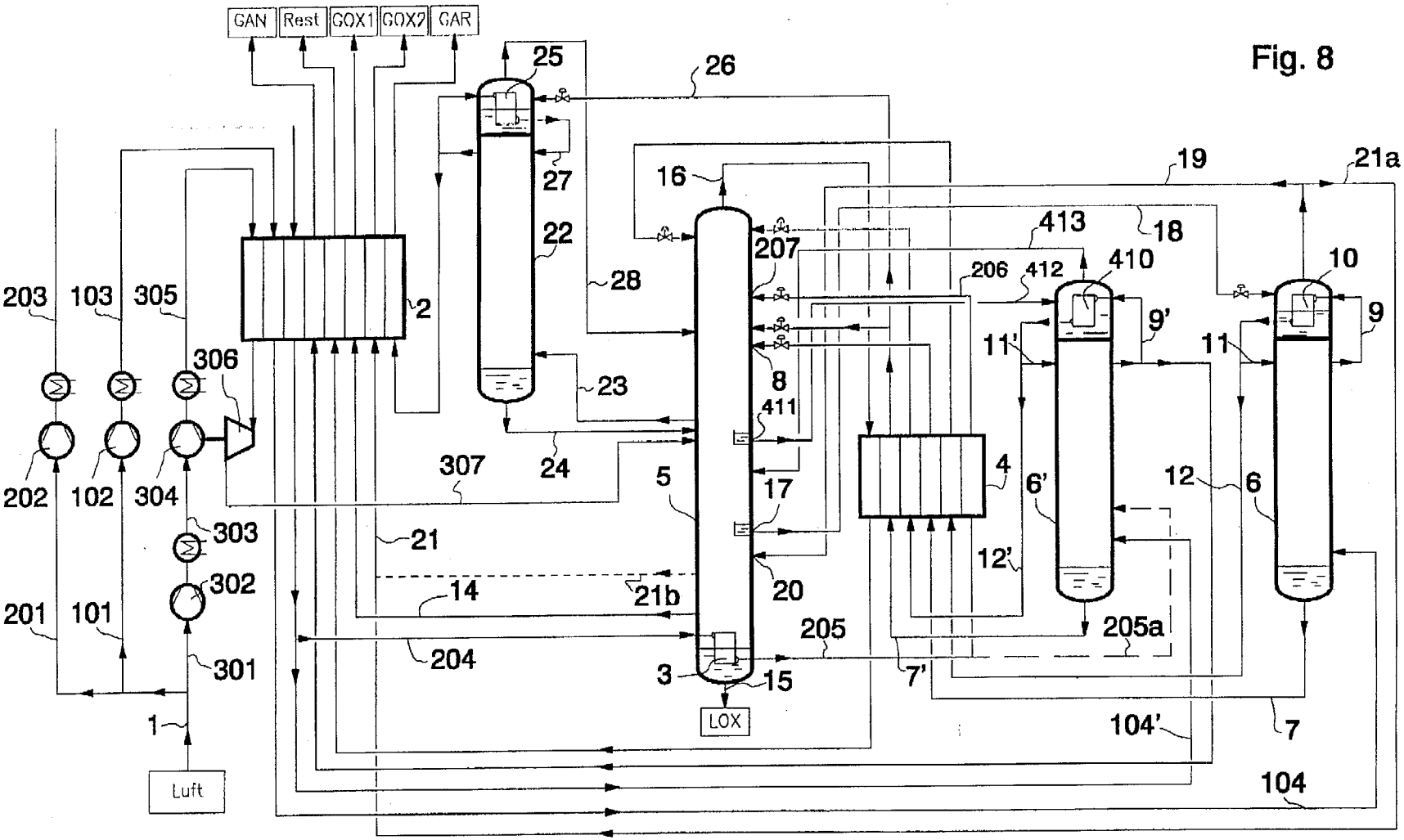

The transfer, shown in FIG. 1 (and also in FIGS. 3 and 5), of the turbine power to the recompressor 304 for further compression of the third airflow 303 upstream from the work-producing relief of pressure is of advantage particularly if within the scope of the inventive method, argon is to be recovered in the known manner, in that an argon-containing oxygen stream is passed from a low-pressure column into a crude argon column (see FIG. 8, for example). Such a recovery of argon is described in detail, for example, in the EP-B-377117. It is, moreover, also possible to do without the compressor 304 and, instead, to drive a generator for generating electrical power with the turbine 306.

The air compressor 30 preferably has one to three stages, the recompressor 202 one to two stages and even more in the case of internal compression. Both machines can be driven by a common shaft. In the sketch, a common compression 30 of the two or three airflows is shown upstream from the cooling facility 31 and the purification equipment 32. Alternatively, the airflows can also be compressed separately to the pressure required in each case and subsequently purified separately according to their pressure level.

One, several or all of the liquid streams, which are to be introduced into the low-pressure column, can be undercooled by indirect heat exchanger 4 against one or several product streams, particularly against the second nitrogen-rich fraction 16 from the head of the low-pressure column 5.

The material exchange elements in the medium-pressure column and the low-pressure column can consist of conventional distillation plates and packings (random and/or ordered). Combinations of different elements in one column are also possible. Because of the low pressure loss, ordered packings are preferred in all columns, particularly in the low-pressure column. These reinforce further the energy-saving effect of the invention.

In the other drawings, distinguishing features, which are identical with or correspond to those of FIG. 1, carry the same reference numbers. In the following, in part only the changes in the different examples are described. Otherwise, the explanation for FIG. 1 applies analogously.

Figure 2:
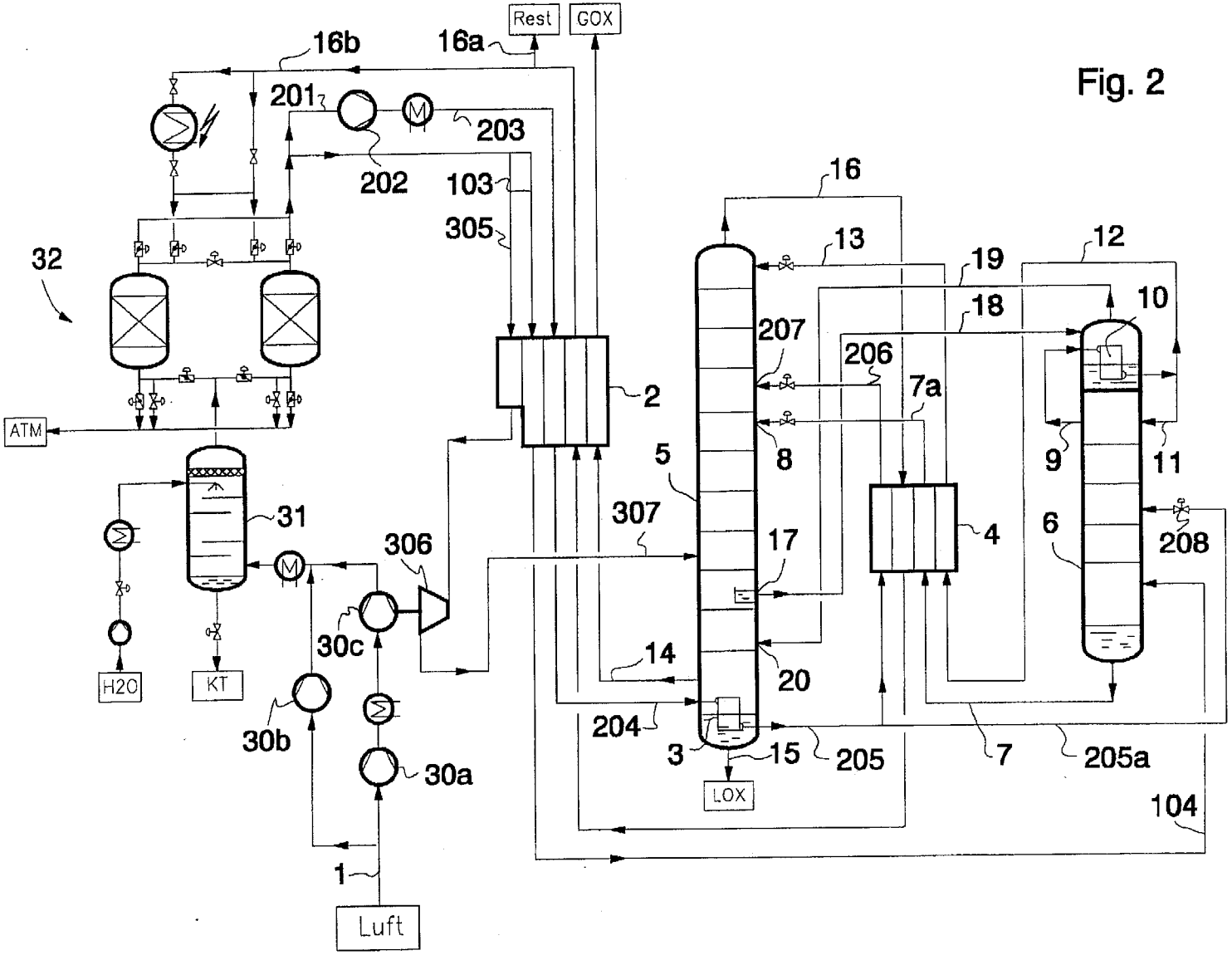
FIG. 2 shows a modification of FIG. 1 with a modified turbine connection.

The most preferred embodiment of the invention is shown in FIG. 2. The mechanical energy, produced in the turbine 306, is used here to compress the air used upstream from the purification equipment 32. For this purpose, the air 1 is divided into two partial streams, which are compressed separately at least partly and subsequently passed together over the cooling facility 31 to the purification equipment 32. A first partial stream comprises 80 to 120 mole percent and preferably 90 to 110 mole percent of the amount of air, which flows through turbine 306; based on the total amount of air used, the proportion of this air depends on the cooling required by the method and constitutes, for example, 5 to 40% of the total amount of air used. This portion of the air is compressed in a compressor 30*a* and compressed further in a compressor 30*c*, which is driven by the turbine 306, to a pressure a little above the pressure of the medium-pressure column. Parallel to this, the remaining air is brought to the same pressure in a compressor 30*b*. The compressors 30*a* and 30*b*, as well as the recompressor 202 are driven with the help of external energy. For this purpose, preferably an electric motor is used, on the shaft of which all the stages of the externally driven compressors 30*a*, 30*b*, 202 are seated. For example, compressor 30*a* has one stage, 30*b* two stages and 202 one stage. Details concerning the nature of the transfer of turbine power are given in the German patent application having the file number 19520200.7. All the variations of the configurations of air compressors, which are described there, can also be used for the present invention.

A concrete numerical example of the process of FIG. 2 is shown in Table 1. The purity of the gaseous oxygen product (GOX) is 95.0%. The compressors of the method have a total power consumption of 11,339 kW.

TABLE 1

| FIG. 2 | Amount (mole/s) | Pressure (bar) | Temperature (°K) | Vapor Portion x ≦ 1.0 | $N_2$ Portion (mole %) | Argon Portion (mole %) | $O_2$ Portion (mole %) |
|---|---|---|---|---|---|---|---|
| 1 | 2846.1 | 1.00 | 295.0 | 1.00 | 78.12 | 0.93 | 20.95 |
| before 30a | 107.0 | 1.00 | 295.0 | 1.00 | 78.12 | 0.93 | 20.95 |
| before 30b | 2739.1 | 1.00 | 295.0 | 1.00 | 78.12 | 0.93 | 20.95 |
| before 30c | 107.0 | 2.59 | 298.0 | 1.00 | 78.12 | 0.93 | 20.95 |
| before 31 | 2846.1 | 2.99 | 298.0 | 1.00 | 78.12 | 0.93 | 20.95 |
| 103 | 1348.6 | 2.99 | 295.0 | 1.00 | 78.12 | 0.93 | 20.95 |
| 201 | 1390.6 | 2.99 | 295.0 | 1.00 | 78.12 | 0.93 | 20.95 |
| 203 | 1390.6 | 3.93 | 298.0 | 1.00 | 78.12 | 0.93 | 20.95 |
| 204 | 1390.6 | 3.83 | 95.1 | 1.00 | 78.12 | 0.93 | 20.95 |
| 205a | 1390.6 | 3.83 | 92.7 | 0.01 | 78.12 | 0.93 | 20.95 |
| 206 | 0.0 | | | | | | |
| 305 | 107.0 | 2.99 | 295.0 | 1.00 | 78.12 | 0.93 | 20.95 |
| before 306 | 107.0 | 2.95 | 96.1 | 1.00 | 78.12 | 0.93 | 20.95 |
| 307 | 107.0 | 1.21 | 83.1 | 0.96 | 78.12 | 0.93 | 20.95 |
| 104 | 1348.6 | 2.89 | 94.1 | 1.00 | 78.12 | 0.93 | 20.95 |
| 18 | 1295.2 | 1.21 | 82.2 | 0.00 | 58.28 | 2.11 | 39.61 |
| 19 | 1295.2 | 1.21 | 86.1 | 1.00 | 58.28 | 2.11 | 39.61 |
| 12 | 930.7 | 2.77 | 87.1 | 0.00 | 99.16 | 0.23 | 0.61 |
| 13 | 930.7 | 2.77 | 87.1 | 0.00 | 99.16 | 0.23 | 0.61 |
| 7 | 1808.4 | 2.89 | 90.4 | 0.00 | 67.29 | 1.29 | 31.42 |
| 7a | 1808.4 | 2.79 | 82.9 | 0.00 | 67.29 | 1.29 | 31.42 |
| 16 | 2226.1 | 1.20 | 79.0 | 1.00 | 99.25 | 0.43 | 0.32 |
| 16a + b | 2226.1 | 1.00 | 297.4 | 1.00 | 99.25 | 0.43 | 0.32 |
| 15 | 0.00 | | | | | | |
| 14 | 620.0 | 1.22 | 91.7 | 1.00 | 2.25 | 2.75 | 95.00 |
| GOX | 620.0 | 1.12 | 297.8 | 1.00 | 2.25 | 2.75 | 95.00 |

Figure 3:
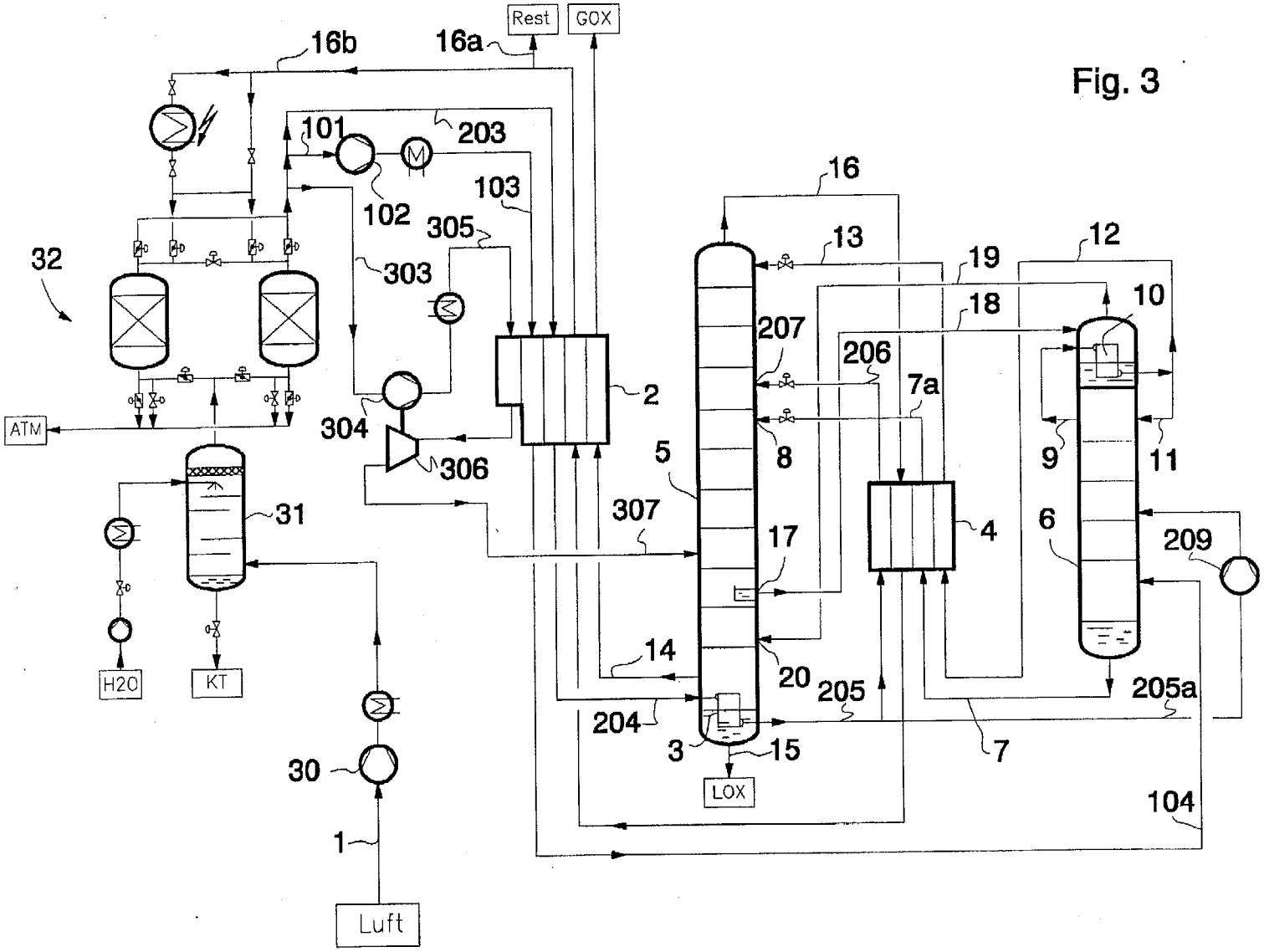
FIG. 3 shows an example of an inventive method of the second variation with two condenser/evaporators for recovering oxygen of high purity.

In FIG. 3, the air, which is to be fractionated, is drawn in at 1 and compressed in an air compressor 30 to a first pressure, precooled in cooling equipment (31) in direct contact with water and freed particularly from water and carbon dioxide in purification equipment (molecular sieve) 32.

A first airflow 101 is compressed further in a recompressor 102 essentially to the pressure of the medium-pressure column (plus line losses) and passed through pipeline 103, the main heat exchanger 2 and pipeline 104 into a medium-pressure column 6. For the inventive method, the medium-pressure column, corresponding to the respective product specifications and pressure losses, is operated under a pressure of 3 to 6 bar, preferably of 4 to 5 bar and particularly at about 4.7 bar.

The sump liquid 7 from the medium-pressure column pressure 6 is thrust at a first intermediate site 8 into a low-pressure column 5, the operating pressure of which is 1.1 to 1.5 bar, preferably 1.2 to 1.4 bar and particularly 1.2 bar. The first nitrogen-rich fraction 9 obtained at the head of the medium-pressure column 6, is condensed in a first condenser/evaporator 10. The thereby resulting nitrogen-containing liquid is returned, on the one hand, over pipeline 11 into the medium-pressure column and, on the other, over pipeline 12 to the head of the low-pressure column 5 (13).

Oxygen of a high purity of, for example, 99.5% by volume, is obtained as sump product of the low-pressure column 5. However, any desired oxygen purity above 98% by volume, particularly between 98% and 99.9% by volume, is achievable with the method. The oxygen product is dram off in gaseous form over pipeline 14, heated in the heat exchanger 2 approximately to ambient temperature and drawn off as gaseous oxygen product. If required, a portion of the pure oxygen can be taken in liquid form from pipeline 15.

In the event that the oxygen is required to be under an elevated pressure, it can be compressed in the gaseous form downstream from the main heat exchanger 2 (external compression). Alternatively, oxygen, removed through pipeline 15, can be brought to pressure (for example, by a pump in pipeline 15) in the liquid state and subsequently evaporated against air in the main heat exchanger 2 or in a subsidiary condenser. In this case, a portion of the first airflow 103 must have a correspondingly higher pressure, in order to be able to evaporate the internally compressed oxygen.

A second nitrogen-rich fraction 16 is removed as gaseous head product from the low-pressure column 5, used in the countercurrent unit 4, when needed, for undercooling liquid streams, which are introduced in the low-pressure column 5, heated in the main heat exchanger 2 against air, which is to be fractionated, and discharged, for example, as residual fraction **16*a*. A portion can be used as regeneration gas 16*b* for the purification equipment 32**.

A second airflow 203 is introduced below approximately the first pressure into the heat exchanger 2. This pressure amounts to 3.5 to 4.5 bar, preferably 3.7 to 4.1 bar and particularly 3.9 bar; in particular, it is, for example, at least 0.5 bar lower than the pressure in the medium-pressure column. The second airflow 204, cooled approximately to the dew point, is liquefied at least partially and preferably completely in a second condenser/evaporator 3 in indirect heat exchange with oxygen-rich liquid in the sump of the low-pressure column 5 and supplied over pipeline 206 at a further intermediate site 207 to the low-pressure column 5. Alternatively or additionally, at least a portion of the liquefied air 205 can be passed with an appropriate increase in pressure (pump 209) into the medium-pressure column 6 (pipeline **205*a***).

At a second intermediate site 17 of the low-pressure column 5, a first intermediate fraction with an oxygen content of 97 to 99% by volume is drawn off in the liquid state. If necessary., it can be delivered with the help of a pump, which is not shown, or a geodetic head. The first intermediate fraction 18 is fed into the evaporation space of the first condenser/evaporator 10 and evaporated there against the condensing, nitrogen-rich fraction 9 from the medium-pressure column 6. The evaporated intermediate fraction is drawn off over pipeline 19 and passed at a further intermediate site 20 back into the low-pressure column 5. The further intermediate site 20 lies, for example, at the level of the second intermediate site 17, but preferably is located below it, as shown in FIG. 3.

Figure 7:
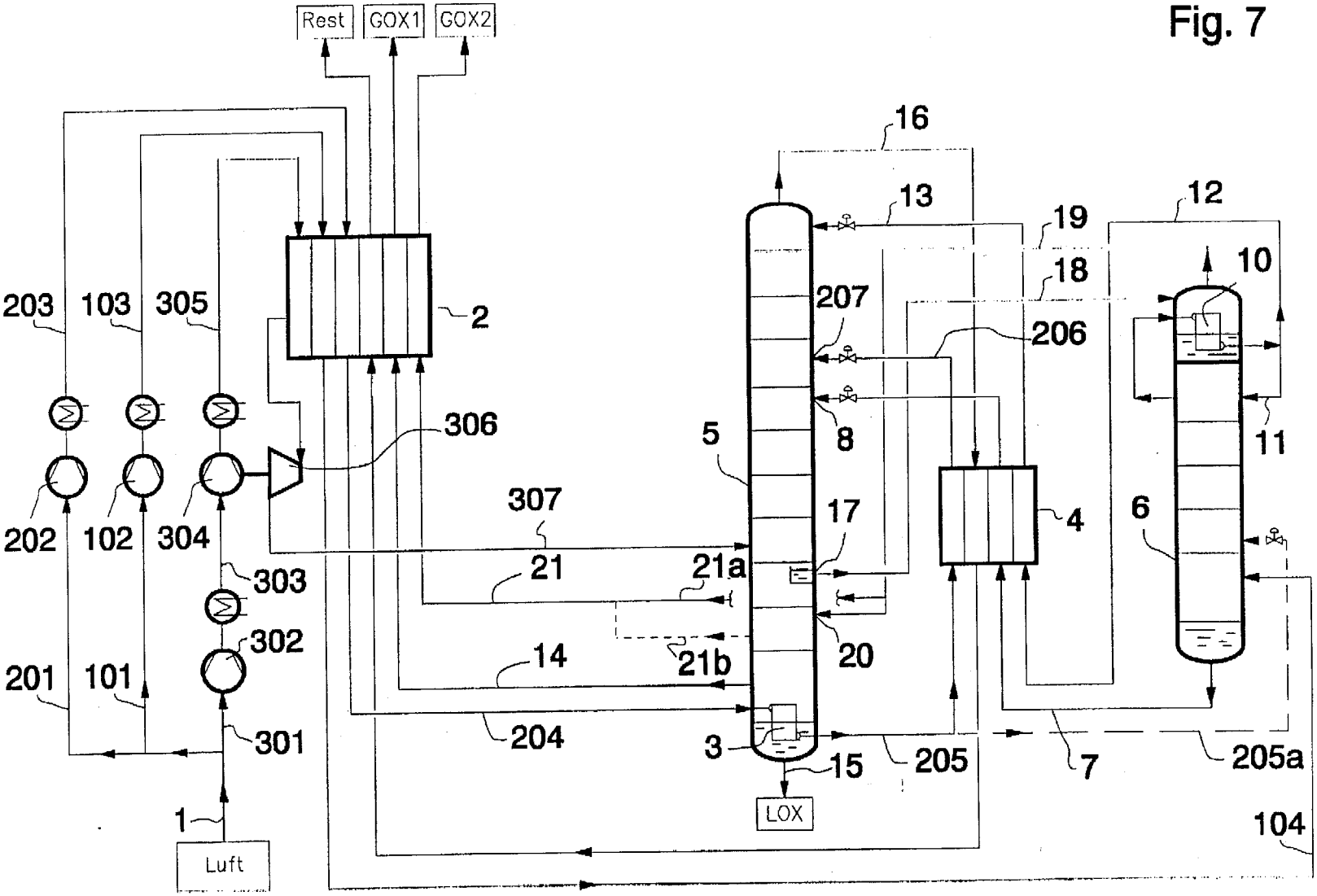
FIG. 7 shows an example of the third variation for recovering two oxygen products of different purity and FIG. 8 shows a further example of the third variation with an additional column and three condenser/evaporators.

In principle, a different part of the evaporated intermediate fraction 19 can be supplied to the main heat exchanger 2 and drawn off as a second oxygen product of lesser purity. This is shown in the examples of FIGS. 7 and 8 of the third variation of the invention. In addition, a liquid product can be obtained through pipeline 15.

A third airflow 303 serves to generate cold. It is recompressed 304 and cooled to an intermediate temperature in the main heat exchanger 2. From there, its pressure is reduced from 1.5 to 8, preferably from 2 to 7 bar and particularly from 5.0 bar, depending on the operating pressure of the cleaning step (see below), in a turbine 306 essentially to the pressure of the low-pressure column and to the dew point temperature and introduced over 307 into the low-pressure column at an intermediate site, which lies above the second intermediate site 17 and below the first intermediate site 8.

The transfer of turbine power to the recompressor 304, shown in FIG. 3, for the further compression of the third airflow 303 upstream from the work-producing relief of pressure is of advantage particularly if, within the scope of the inventive process, argon is recovered in a known manner in that an argon-containing oxygen stream is passed from the low-pressure column into a crude argon column (see, for example, FIG. 8). Such an argon recovery is described in detail, for example, in the EP-B-377117. It is, moreover, also possible to do without the compressor 304 and, instead, to drive a generator for generating electrical power with the turbine 306.

The air compressor 30 preferably has one to three stages and the recompressor 102 one to two stages. In the case of internal compression, additional compressor stages for a partial stream of the first airflow are required. Both machines can be driven by a common shaft. In the sketch, a common compression 30 of the two or three airflows is shown upstream from the cooling facility 31 and the purification equipment 32. Alternatively, the airflows can also be compressed separately to the respectively required pressure and subsequently purified separately according to their pressure level.

One, several or all of the liquid streams, which are to be introduced into the low-pressure column, can be undercooled by indirect heat exchange 4 against one or several product streams, particularly against the second nitrogen-rich fraction 16 from the head of the low-pressure column 5.

The material exchange elements in the medium-pressure column and the low-pressure column can consist of conventional distillation plates and packings (random and/or ordered). Combinations of different elements in one column are also possible. Because of the low pressure loss, ordered packings are preferred in all columns, particularly in the low-pressure column. These reinforce further the energy-saving effect of the invention.

Figure 4:
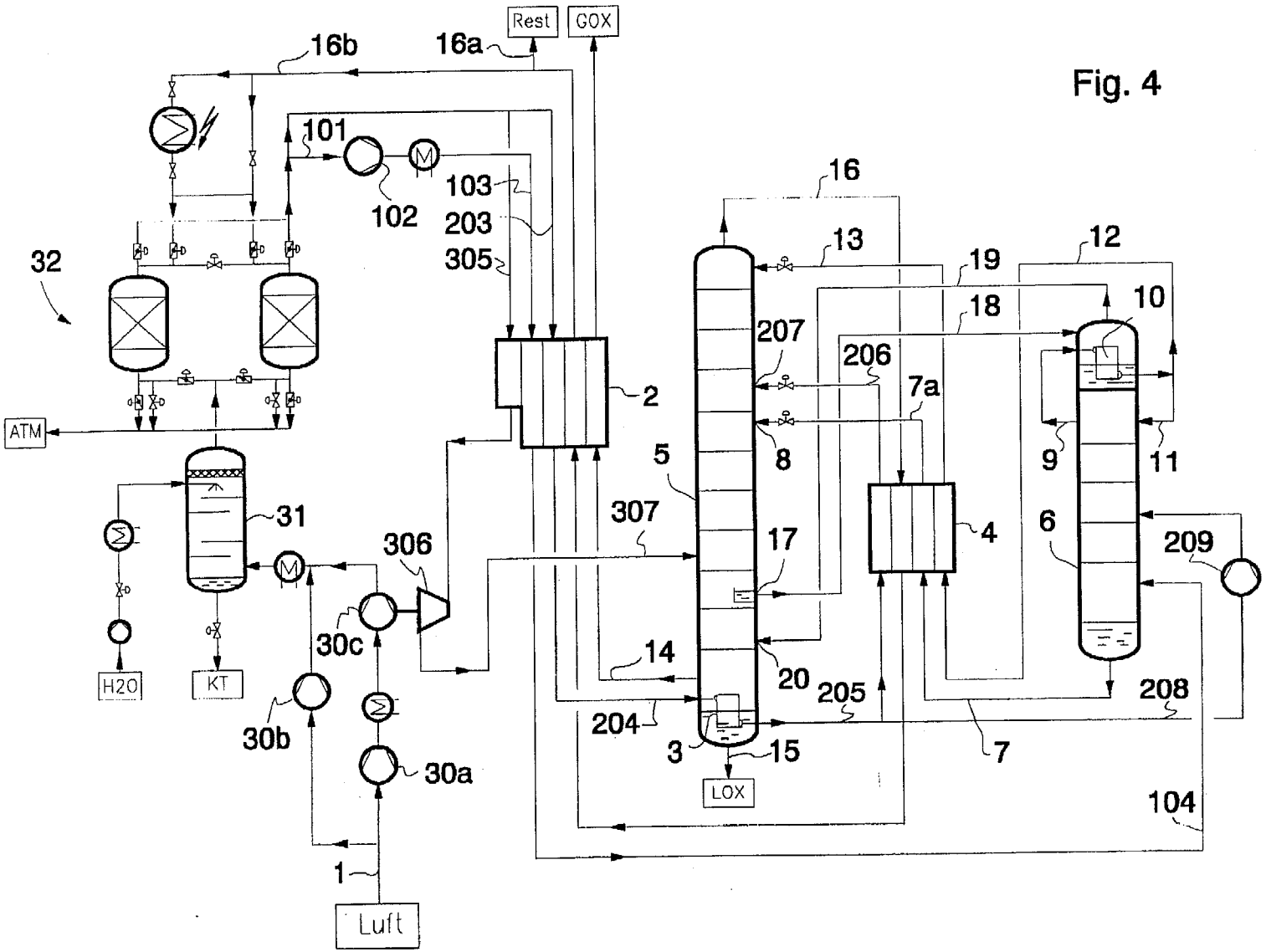
FIG. 4 shows a modification of FIG. 3 with a modified turbine connection.

FIG. 4 differs from FIG. 3 in the same way as FIG. 2 differs from FIG. 1. The information concerning turbine and compressor connections of FIG. 2 therefore also apply to FIG. 4.

A numerical example of the process of FIG. 4 is shown in Table 2. The purity in the gaseous oxygen product (GOX) is 99.5%. The compressors of the method have a total power consumption of 15045 kW.

TABLE 2

| FIG. 4 | Amount (mole/s) | Pressure (bar) | Temperature (°K) | Vapor Portion x ≦ 1.0 | $N_2$ Portion (mole %) | Argon Portion (mole %) | $O_2$ Portion (mole %) |
|---|---|---|---|---|---|---|---|
| 1 | 2985.0 | 1.00 | 295.0 | 1.00 | 78.12 | 0.93 | 20.95 |
| before 30a | 34.9 | 1.00 | 295.0 | 1.00 | 78.12 | 0.93 | 20.95 |
| before 30b | 2950.1 | 1.00 | 295.0 | 1.00 | 78.12 | 0.93 | 20.95 |
| before 30c | 34.9 | 3.26 | 298.0 | 1.00 | 78.12 | 0.93 | 20.95 |
| before 31 | 2985.0 | 4.02 | 298.0 | 1.00 | 78.12 | 0.93 | 20.95 |
| 305 | 34.9 | 4.02 | 298.0 | 1.00 | 78.12 | 0.93 | 20.95 |
| 307 | 34.9 | 1.21 | 83.0 | 0.94 | 78.12 | 0.93 | 20.95 |
| 101 | 2150.6 | 4.02 | 298.0 | 1.00 | 78.12 | 0.93 | 20.95 |
| 203 | 799.4 | 4.02 | 298.0 | 1.00 | 78.12 | 0.93 | 20.95 |
| 103 | 2150.6 | 4.83 | 298.0 | 1.00 | 78.12 | 0.93 | 20.95 |
| 104 | 2150.6 | 4.83 | 100.0 | 1.00 | 78.12 | 0.93 | 20.95 |
| 204 | 799.4 | 3.92 | 97.7 | 1.00 | 78.12 | 0.93 | 20.95 |
| 206 | 799.4 | 3.92 | 93.0 | 0.00 | 78.12 | 0.93 | 20.95 |
| 208 | 0.00 | | | | | | |
| 19 | 1708.7 | 1.21 | 91.9 | 1.00 | 0.60 | 0.60 | 98.80 |
| 18 | 1708.7 | 1.21 | 91.8 | 0.00 | 0.60 | 0.60 | 98.80 |
| 12 | 1085.8 | 4.58 | 92.9 | 0.00 | 99.41 | 0.46 | 0.13 |
| 13 | 1085.8 | 4.53 | 92.6 | 0.00 | 99.41 | 0.46 | 0.13 |
| 7 | 1064.8 | 4.73 | 97.8 | 0.00 | 55.87 | 1.43 | 42.70 |
| 7a | 1064.8 | 4.63 | 79.0 | 0.00 | 55.87 | 1.43 | 42.70 |
| 16 | 2365.0 | 1.20 | 78.9 | 1.00 | 98.60 | 1.00 | 0.40 |
| 16a + b | 2365.0 | 1.00 | 297.2 | 1.00 | 98.60 | 1.00 | 0.40 |
| 15 | 0.00 | | | | | | |
| 14 | 620.0 | 1.22 | 92.0 | 1.00 | 0.00 | 0.50 | 99.50 |
| GOX | 620.0 | 1.12 | 297.7 | 1.00 | 0.00 | 0.50 | 99.50 |

In addition, the method and apparatus of FIGS. 1 and 2 can have a third air-operated condenser/evaporator, in which a further liquid intermediate fraction from the low-pressure column is evaporated. Details of this addition are shown and explained by means of FIGS. 5 and 6. The second intermediate site can therefore be higher, for example, above the site 8 where sump liquid 7 from the medium-pressure column is fed in and/or above the site 207 of the possible addition of liquid air.

Figure 5:
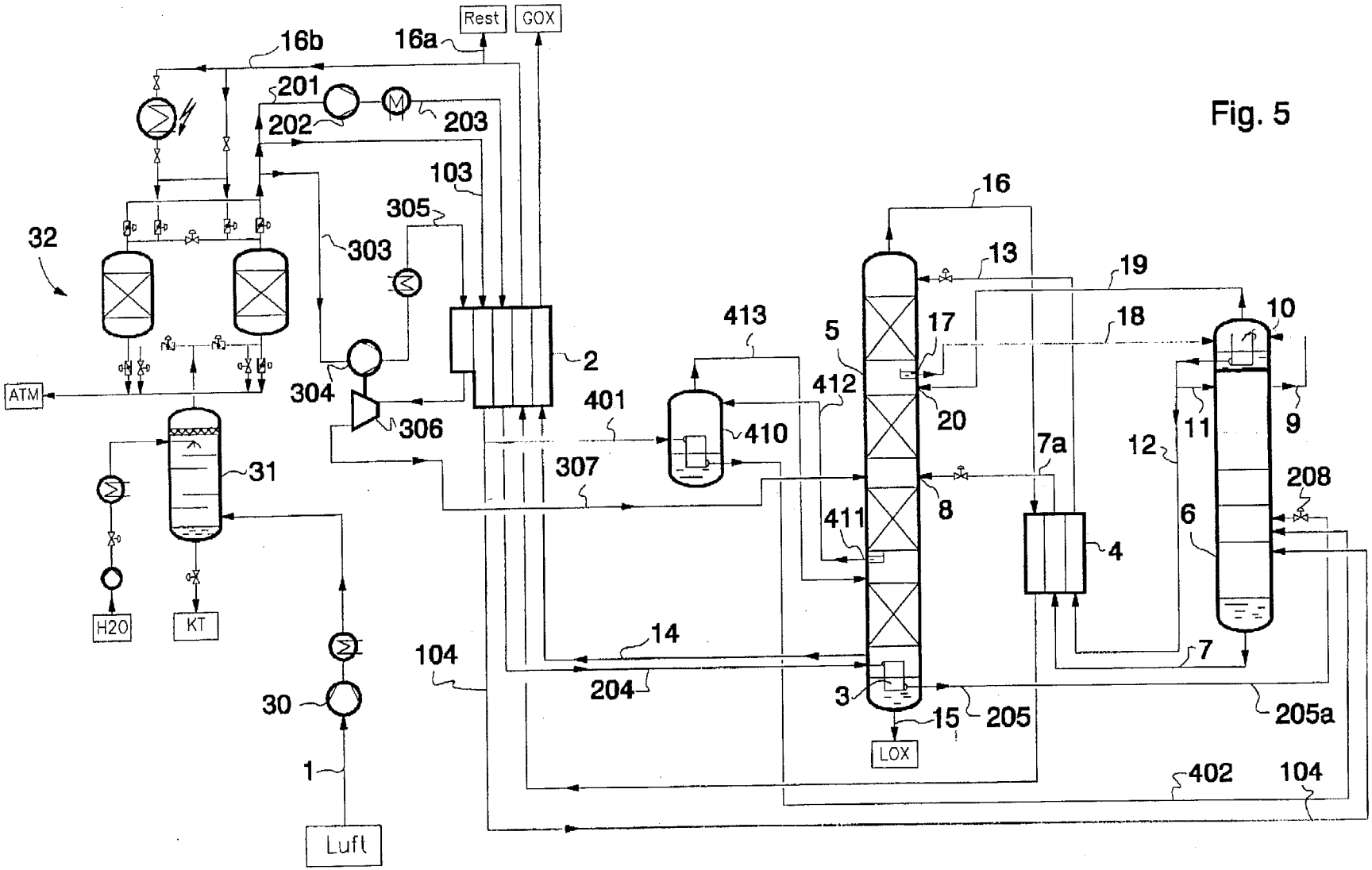
FIG. 5 shows an example of a method with three condenser/evaporators.

FIG. 5 differs from FIG. 1 owing to a further, third condenser/evaporator 410. The evaporation side of the latter is charged with a second liquid intermediate fraction 412, which is taken from the low-pressure column 5 at a third intermediate site 411. This intermediate fraction 412 is evaporated at least partially and preferably completely. The vapor formed is returned over pipeline 413 to the low-pressure column 5 and fed in preferably a few theoretical plates below the third intermediate site 411. A third airflow 401 flows through the liquefaction side of the third condenser/evaporator 410 essentially at the pressure of the medium-pressure column. The third airflow 401 is branched off here from the first airflow 103 at the cold end of the main heat exchanger 2 and liquefied in 410 at least partially, for example, to the extent of 10 to 30 mole percent and preferably to about 20 mole percent. The partially condensed air 402 is fed into the medium-pressure column 6. If required, a portion can also be supplied to the low-pressure column 5.

Figure 6:
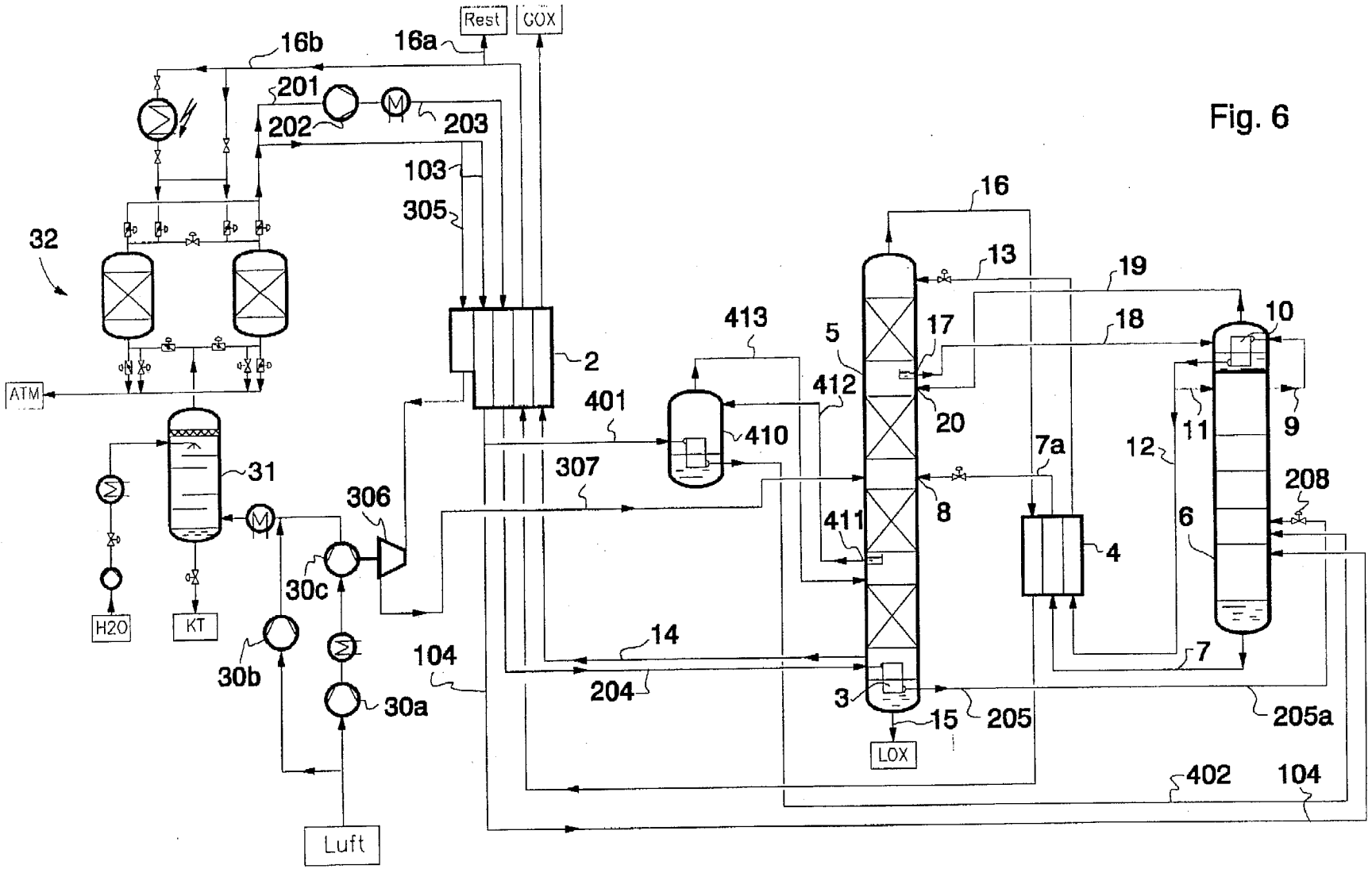
FIG. 6 shows a modification of FIG. 5 with a special turbine connection.

The differences between FIGS. 6 and 5 are the same as those between FIGS. 2 and 1. The information concerning turbine and compressor connections of FIG. 2 also therefore apply for FIG. 4.

Table 3 contains a numerical example relating to FIG. 6. At a 94.8% purity for the gaseous oxygen product (GOX), the total power consumption is 11273 kW here.

(plus line losses) and introduced into a medium-pressure column 6 over pipeline 103 through the main heat exchanger 2 and over pipeline 104. Depending on the respective product specifications and pressure losses, the medium-pressure column is operated under a pressure of 3 to 6 bar and preferably 4 to 5 bar and particularly about 4.8 bar.

The sump liquid 7 from the medium-pressure column 6 is thrust at a first intermediate site 8 into a low-pressure column 5, the operating pressure of which is 1.1 to 1.5 bar, preferably 1.2 to 1.4 bar and particularly about 1.3 bar. The first nitrogen-rich fraction 9, obtained at the head of the medium-pressure column 6, is condensed in a first condenser/evaporator 10. The thereby resulting nitrogen-containing liquid is partly returned over pipeline 11 to the medium-pressure column and partly supplied over pipeline 12 to the head of the low-pressure column 5 (13).

Oxygen of high purity (at least 98% by volume, preferably 99 to 99.9% by volume and particularly about 99.5% by volume) is obtained as sump product of the low-pressure column 5. It is drawn off in gaseous form over pipeline 14, heated in the main heat exchanger 2 approximately to ambient temperature and drawn off as a first oxygen product GOX1. If required, a portion of the pure oxygen can be removed in the liquid state through pipeline 15.

A second nitrogen-rich fraction 18 is removed as a gaseous head product from the low-pressure column 5, used, when required, in the countercurrent unit for undercooling liquid streams, which are introduced into the low-pressure column 5, heated in the main heat exchanger 2 against air that is to be fractionated and discharged, for example, as residual fraction.

TABLE 3

| FIG. 6 | Amount (mole/s) | Pressure (bar) | Temperature (°K) | Vapor Portion x ≦ 1.0 | $N_2$ Portion (mole %) | Argon Portion (mole %) | $O_2$ Portion (mole %) |
|---|---|---|---|---|---|---|---|
| 1 | 2850.0 | 1.00 | 295.0 | 1.00 | 78.12 | 0.93 | 20.95 |
| before 30a | 130.1 | 1.00 | 295.0 | 1.00 | 78.12 | 0.93 | 20.95 |
| before 30b | 2719.9 | 1.00 | 295.0 | 1.00 | 78.12 | 0.93 | 20.95 |
| before 30c | 130.1 | 2.55 | 298.0 | 1.00 | 78.12 | 0.93 | 20.95 |
| before 31 | 2850.0 | 3.00 | 315.0 | 1.00 | 78.12 | 0.93 | 20.95 |
| 103 | 2850.0 | 3.00 | 298.0 | 1.00 | 78.12 | 0.93 | 20.95 |
| 201 | 1524.0 | 3.00 | 298.0 | 1.00 | 78.12 | 0.93 | 20.95 |
| 203 | 1326.0 | 3.00 | 298.0 | 1.00 | 78.12 | 0.93 | 20.95 |
| 204 | 1326.0 | 3.83 | 298.0 | 1.00 | 78.12 | 0.93 | 20.95 |
| 205a | 1326.0 | 3.73 | 95.0 | 1.00 | 78.12 | 0.93 | 20.95 |
| 206 | 1326.0 | 3.73 | 92.6 | 0.19 | 78.12 | 0.93 | 20.95 |
| 305 | 130.1 | 3.73 | 92.6 | 0.19 | 78.12 | 0.93 | 20.95 |
| before 306 | 130.1 | 2.90 | 98.0 | 1.00 | 78.12 | 0.93 | 20.95 |
| 307 | 130.1 | 1.21 | 83.1 | 0.97 | 78.12 | 0.93 | 20.95 |
| 401 | 738.8 | 2.90 | 98.0 | 1.00 | 78.12 | 0.93 | 20.95 |
| 402 | 728.8 | 2.90 | 91.0 | 0.69 | 78.12 | 0.93 | 20.95 |
| 104 | 655.1 | 2.90 | 98.0 | 1.00 | 78.12 | 0.93 | 20.95 |
| 19 | 1298.9 | 1.21 | 86.4 | 1.00 | 55.57 | 2.68 | 41.75 |
| 18 | 1298.9 | 1.21 | 82.5 | 0.00 | 55.57 | 2.68 | 41.75 |
| 12 | 902.0 | 2.84 | 87.4 | 0.00 | 98.31 | 0.34 | 1.35 |
| 13 | 902.2 | 2.84 | 87.4 | 0.00 | 98.31 | 0.34 | 1.35 |
| 7 | 1817.9 | 2.95 | 90.6 | 0.00 | 68.10 | 1.23 | 30.67 |
| 7a | 1817.9 | 2.85 | 83.0 | 0.00 | 68.10 | 1.23 | 30.67 |
| 16 | 2230.0 | 1.20 | 79.0 | 1.00 | 99.30 | 0.28 | 0.42 |
| 16a + b | 2230.0 | 1.00 | 297.3 | 1.00 | 99.30 | 0.28 | 0.42 |
| 411 | 206.9 | 1.21 | 90.0 | 0.00 | 6.29 | 4.13 | 89.58 |
| 413 | 206.9 | 1.21 | 91.3 | 1.00 | 6.29 | 4.13 | 89.58 |
| 15 | 0.0 | | | | | | |
| 14 | 620.0 | 1.22 | 91.7 | 1.00 | 1.91 | 3.27 | 94.82 |
| GOX | 620.0 | 1.12 | 297.8 | 1.00 | 1.91 | 3.27 | 94.82 |

For the example of FIG. 7, air, which is to be fractionated, is drawn in at 1. A first airflow 101 is compressed in 102 essentially to the pressure of the medium-pressure column A second airflow 201 is compressed in a compressor 202, introduced (203) at about ambient temperature into the main heat exchanger 2, cooled there approximately to the dew point, liquefied at least partially and preferably completely in a second condenser/evaporator 3 in indirect heat exchange with oxygen-rich liquid in the sump of the low-pressure column 5 and fed over pipelines 205 and 206 at a second intermediate site 207 into the low-pressure column 5. As indicated by pipeline 205*a*, which is drawn by broken lines, a portion of the condensed second airflow can also be taken to the medium-pressure column 6. In the event that the liquefaction pressure in 3 is less than the operating pressure of the medium-pressure column 6, pipeline 205*a* contains a pump, which is not shown. Within the scope of the invention, however, the whole of the condensed air preferably is supplied directly to the low-pressure column 5.

At a third intermediate site 17 of the low-pressure column 5, an intermediate fraction with an oxygen content of less than 98% by volume, preferably of 90 to 98% by volume and particularly of 95% by volume, corresponding to the product specification, is drawn off in liquid form and, if necessary with the help of a pump, which is not shown, or a geodetic head, supplied over pipeline 18 to the evaporation space of the first condenser/evaporator 10 and evaporated there against the condensing nitrogen-rich fraction 9 from the medium-pressure column 6. The evaporated intermediate fraction is drawn off over pipeline 19 and returned at least partially at a fourth intermediate site 20 to the low-pressure column 5. The fourth intermediate site 20 is, for example, at the level of the third intermediate site 17. Preferably, however, it is below this level, as shown in FIG. 7. A different portion of the evaporated intermediate fraction 19 is passed through pipelines 21*a* and 21 to the main heat exchanger 2 and drawn off as a second oxygen product of average purity GOX2. In the representation of FIG. 7, pipeline 21*a* branches off from pipeline 19 before the latter discharges into the low-pressure column 5; alternatively or additionally, it is possible to connect the pipeline 21 over 21*b* with the low-pressure column approximately at the level of the intermediate site 20 and, with that, to remove oxygen product of medium purity from the low-pressure column.

A third airflow 301, which is compressed at 302, taken through pipeline 303 to a recompressor 304 and cooled in the heat exchanger 2 to an intermediate temperature, serves to generate cold. From there, depending on the operating pressure of the purification step (see below), the pressure of the airflow 301 is reduced from 1.5 to 8, preferably 2 to 7 bar and particularly about 8.5 bar in a turbine 306 essentially to the pressure of the low-pressure column and the to dew point temperature and introduced over 307 into the low-pressure column at an intermediate site 308, which lies above the third intermediate site 17 and below the first intermediate site 8.

In the sketch, a separate compression 102, 202, 302 of the two or three airflows 101, 201, 301 is shown. Alternatively, the airflows can be compressed by a common compressor, disposed in pipeline 1, preferably to the lowest of the pressures required in the pipelines 103, 203 and 303, for example, to the particular pressure in pipeline 303. In the latter case, compressor 302 would be omitted and the compressors 102 and 202 would only have to overcome the pressure difference between pipeline 303 and 103 and/or 203. In the event that the liquefaction pressure of the second airflow 204 is about equal to the pressure of the medium-pressure column 8, the first airflow 101, 103, 104 and the second airflow 201, 203, 204 could also be compressed together and optionally passed together through the main heat exchanger 2. The types of air compression, described in the preceding examples, can also be used in FIGS. 7 and 8.

One, several or all liquid streams, which are to be introduced into the low-pressure column, can be undercooled in direct heat exchange 4 against one or several product streams, particularly against the second nitrogen-rich fraction 16 from the head of the low-pressure column 5.

The removal of water and carbon dioxide from the air, which is to be fractionated, is not shown in FIGS. 7 and 8. However, it can be brought about by any of the conventional methods, for example, with the help of a molecular sieve. This may also be disposed, for example, in pipeline 1; alternatively, it is possible to dispose several molecular sieves, for example, in pipelines 103, 203 and 303.

FIG. 8 shows two further developments of the inventive method and apparatus, which are basically independent of one another, on the one hand namely, an additional column 6' and, on the other, a crude argon column 22, which is connected with the low-pressure column 5.

The additional column 6' is supplied by a fourth airflow 104', which was compressed in the example together with the second airflow 201,203, 204. In addition, a portion 205*a* of the liquefied second airflow 205 can be passed into the additional column 6'. The additional column 6' is operated at a pressure, which lies between the pressure of the low-pressure column 5 and the pressure of the medium-pressure column 6, for example, at 2 to 5, preferably at 3 to 4 bar and particularly at 3.5 bar.

The head of the additional column 6' is cooled with a second liquid intermediate fraction 412, the oxygen content of which is lower than that of the first intermediate fraction 18 for cooling the head of the medium-pressure column. The fraction, evaporated in the condenser/evaporator 410, is returned over 413 to the low-pressure column 5 at a site corresponding to its composition. A portion of this vapor can, if required, be recovered as a third oxygen product (not shown). The sump fraction 7' and a portion 12' of a third nitrogen-rich fraction, liquefied in the condenser/evaporator 410, are thrust into the low-pressure column 5. In order to reduce equipment costs, the additional column 6' and the medium-pressure column 6 can deviate from the representation in FIG. 8 and also be connected partially or completely in parallel, in that the pipelines 18 and 412, 19 and 413, 7 and 7' and/or 12 and 12' in each case are connected at the same site with the low-pressure column 5. The liquefied second airflow 206 and the sump fraction 7 (and/or optionally the sump fraction 7') can also be introduced jointly into the low-pressure column. With that, the invention deviates from the representation in FIGS. 7 and 8 and can be realized with a simplified apparatus and less costly controls.

The low-pressure column 5 of FIGS. 1 to 8 can be connected with the crude argon column 22, shown in FIG. 8, over a gas feed line 23 and a liquid return line 24. Argon and oxygen are separated from one another within the crude argon column 22 by known means. By evaporating a portion 26 of the liquid sump fraction 7' from the additional column 6', liquid backflow 27 is produced in the head condenser 25 of the crude argon column 22. (Alternatively, the whole of the sump fraction 7' can also be passed through the head condenser 25. In addition, it is possible to use one of the fractions 7 or 206 or a mixture of fractions 7, 7' and/or 208 instead for cooling the head condenser 25.) The evaporated fraction 26 preferably is passed to the low-pressure column 5. Crude argon GAR is drawn off, for example, in gaseous form at the head of the crude argon column 22.

The material exchange elements in said rectifier columns can consist of conventional distillation plates and packings (random and/or ordered). Combinations of different elements in one column are also possible. Because of the low pressure loss, ordered packings are preferred in all columns, particularly in the low-pressure column. These reinforce further the energy-saving effect of the invention.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A method for the low temperature fractionation of air, comprising:

forming a first airflow and a second airflow, passing the first airflow into a medium-pressure column, which is operated at above atmospheric pressure and in which an oxygen-enriched sump liquid and a first nitrogen-rich fraction are obtained, passing the sump liquid at a first intermediate site into a low-pressure column, which is operated under a pressure lower than that of the medium-pressure column, condensing the first nitrogen-rich fraction at least partially by indirect heat exchange, a nitrogen-rich liquid being produced, using a first portion of the nitrogen-rich liquid as backflow in the medium-pressure column, using a second portion of the nitrogen-rich liquid as backflow in the low-pressure column, obtaining a second nitrogen-rich fraction at the head of the low-pressure column and obtaining an oxygen-rich liquid in the sump of the low-pressure column, evaporating the oxygen-rich liquid at least partially by indirect heat exchange against the second airflow in an indirect heat exchanger, using at least a portion of the evaporated, oxygen-rich liquid as rising vapor in the low-pressure column, drawing off a different portion of the evaporated, oxygen-rich liquid and/or a portion of the oxygen-rich liquid as oxygen product(s), evaporating a first liquid intermediate fraction, which is obtained in the low-pressure column at a second intermediate site, at least partially by the indirect heat exchange for condensing the first nitrogen-rich fraction, and using at least a portion of the evaporated first intermediate fraction as rising vapor in the low-pressure column, wherein the second airflow is under a pressure during the heat exchange in the indirect heat exchanger which is different than the pressure of the medium pressure column, and wherein the second airflow is under a pressure during the heat exchange in the indirect heat exchanger which is less than the pressure of the medium pressure column.

2. The method according to claim 1, wherein a portion of the evaporated first intermediate fraction and/or a fraction from the low-pressure column, obtained below the second intermediate site is/are obtained as a further oxygen product, the purity of which is lower than that of the oxygen product obtained in the form of an evaporated, oxygen-rich liquid and/or in the form of an oxygen-rich liquid from the sump of the low-pressure column.

3. The method according to claim 1, wherein the difference between the pressure of the second airflow during the indirect heat exchange for evaporating the oxygen-rich liquid and the pressure of the first airflow while it is being supplied to the medium-pressure column is at least 0.8 bar.

4. The method according to claim 1, wherein the low-pressure column is operated at a pressure only slightly above atmospheric, which is sufficient for removing the second, nitrogen-rich fraction, optionally after passage through one or several heat exchangers, essentially at atmospheric pressure from the process and/or using it as regenerating gas in purification equipment.

5. The method according to claim 1, wherein the evaporation space of the indirect heat exchanger, in which the at least partial evaporation of the oxygen-rich liquid takes place, communicates with the lower region of the lower pressure column.

6. The method according to claim 1, wherein the pressure on a further airflow is relieved in a work-producing manner and that the airflow is introduced into the low-pressure column.

7. The method according to claim 6, wherein, energy, obtained by the work-producing relief of pressure of the further airflow, is used for compressing third partial stream upstream from the work-producing relief of pressure.

8. The method according to claim 7, wherein the air used is purified in purification equipment and that the energy, obtained in the work-producing relief of pressure is used to compress the air used upstream from the purification equipment.

9. The method according to claim 1, wherein a product flow is removed in liquid form from one of the columns, brought to pressure in the liquid state and subsequently evaporated.

10. The method according to claim 1, wherein said forming a first airflow and a second airflow comprises compressing a supply of air to a first pressure and subsequently splitting said air supply to form said first and second airflows.

11. A method for the low temperature fractionation of air, comprising:

forming a first airflow and a second airflow, passing the first airflow into a medium-pressure column, which is operated at above atmospheric pressure and in which an oxygen-enriched sump liquid and a first nitrogen-rich fraction are obtained, passing the sump liquid at a first intermediate site into a low-pressure column, which is operated under a pressure lower than that of the medium-pressure column, condensing the first nitrogen-rich fraction at least partially by indirect heat exchange, a nitrogen-rich liquid being produced, using a first portion of the nitrogen-rich liquid as backflow in the medium-pressure column, using a second portion of the nitrogen-rich liquid as backflow in the low-pressure column, obtaining a second nitrogen-rich fraction at the head of the low-pressure column and obtaining an oxygen-rich liquid in the sump of the low-pressure column, evaporating the oxygen-rich liquid at least partially by indirect heat exchange against the second airflow in an indirect heat exchanger, using at least a portion of the evaporated, oxygen-rich liquid as rising vapor in the low-pressure column, drawing off a different portion of the evaporated, oxygen-rich liquid and/or a portion of the oxygen-rich liquid as oxygen product(s), evaporating a first liquid intermediate fraction, which is obtained in the low-pressure column at a second intermediate site, at least partially by the indirect heat exchange for condensing the first nitrogen-rich fraction, and using at least a portion of the evaporated first intermediate fraction as rising vapor in the low-pressure column, wherein the second airflow is under a pressure during the heat exchange in the indirect heat exchanger which is different than the pressure of the medium pressure column, and wherein a portion of the evaporated first intermediate fraction and/or a fraction from the low-pressure column, obtained below the second intermediate site is/are obtained as a further oxygen product, the purity of which is lower than that of the oxygen product obtained in the form of an evaporated, oxygen-rich liquid and/or in the form of an oxygen-rich liquid from the sump of the low-pressure column.

12. A method for the low temperature fractionation of air, comprising:

forming a first airflow and a second airflow, passing the first airflow into a medium-pressure column, which is operated at above atmospheric pressure and in which an oxygen-enriched sump liquid and a first nitrogen-rich fraction are obtained, passing the sump liquid at a first intermediate site into a low-pressure column, which is operated under a pressure lower than that of the medium-pressure column, condensing the first nitrogen-rich fraction at least partially by indirect heat exchange, a nitrogen-rich liquid being produced, using a first portion of the nitrogen-rich liquid as backflow in the medium pressure-column, using a second portion of the nitrogen-rich liquid as backflow in the low-pressure column, obtaining a second nitrogen-rich fraction at the head of the low-pressure column and obtaining an oxygen-rich liquid in the sump of the low-pressure column, evaporating the oxygen-rich liquid at least partially by indirect heat exchange against the second airflow in an indirect heat exchanger, using at least a portion of the evaporated, oxygen-rich liquid as rising vapor in the low-pressure column, drawing off a different portion of the evaporated, oxygen-rich liquid and/or a portion of the oxygen-rich liquid as oxygen product(s), evaporating a first liquid intermediate fraction, which is obtained in the low-pressure column at a second intermediate site, at least partially by the indirect heat exchange for condensing the first nitrogen-rich fraction, and using at least a portion of the vaporated first intermediate fraction as rising vapor in the low-pressure column, wherein the second airflow is under a pressure during the heat exchange in the direct heat exchanger which is different than the pressure of the medium pressure column, and wherein the indirect heat exchange between the first liquid intermediate fraction and the first nitrogen-rich fraction is carried out in a heat exchanger which is disposed outside of the low-pressure column.

13. A method according to claim 12, wherein a product flow is removed in liquid form from one of the columns, brought to pressure in the liquid state and subsequently evaporated.

14. A method for the low temperature fractionation of air, comprising:

forming a first airflow and a second airflow, passing the first airflow into a medium-pressure column, which is operated at above atmospheric pressure and in which an oxygen-enriched sump liquid and a first nitrogen-rich fraction are obtained, passing the sump liquid at a first intermediate site into a low-pressure column, which is operated under a pressure lower than that of the medium-pressure column, condensing the first nitrogen-rich fraction at least partially by indirect heat exchange, a nitrogen-rich liquid being produced, using a first portion of the nitrogen-rich liquid as backflow in the medium-pressure column, using a second portion of the nitrogen-rich liquid as backflow in the low-pressure column, obtaining a second nitrogen-rich fraction at the head of the low-pressure column and obtaining an oxygen-rich liquid in the sump of the low-pressure column, evaporating the oxygen-rich liquid at least partially by indirect heat exchange against the second airflow in an indirect heat exchanger, using at least a portion of the evaporated, oxygen-rich liquid as rising vapor in the low-pressure column, drawing off a different portion of the evaporated, oxygen-rich liquid and/or a portion of the oxygen-rich liquid as oxygen product(s), evaporating a first liquid intermediate fraction, which is obtained in the low-pressure column at a second intermediate site, at least partially by the indirect heat exchange for condensing the first nitrogen-rich fraction, and using at least a portion of the evaporated first intermediate fraction as rising vapor in the low-pressure column, wherein the second airflow is under a pressure during the heat exchange in the indirect heat exchanger which is different than the pressure of the medium pressure column, and wherein a second liquid intermediate fraction is removed from the low pressure column at a third intermediate site and evaporated at least partially in indirect heat exchange, and wherein the evaporated second intermediate fraction is returned at least partially to the low-pressure column.

15. The method according to claim 14, wherein the indirect heat exchange for evaporating the second intermediate fraction is carried out against a third airflow, which is condensed at least partially at the same time.

16. The method according to claim 14, wherein an additional airflow is passed into an additional column, which is operated under a pressure, which lies between the pressure of the low-pressure column and the pressure of the medium-pressure column, the indirect heat exchange for evaporating the second intermediate fraction being carried out against the head fraction of the additional head column, which is condensed at least partially at the same time.

17. A method for the low temperature fractionation of air, comprising:

forming a first airflow and a second airflow, passing the first airflow into a medium-pressure column, which is operated at above atmospheric pressure and in which an oxygen-enriched sump liquid and a first nitrogen-rich fraction are obtained, passing the sump liquid at a first intemediate site into a low-pressure column, which is operated under a pressure lower than that of the medium-pressure column, condensing the first nitrogen-rich fraction at least partially by indirect heat exchange, a nitrogen-rich liquid being produced, using a first portion of the nitrogen-rich liquid as backflow in the medium-pressure column, using a second portion of the nitrogen-rich liquid as backflow in the low-pressure column, obtaining a second nitrogen-rich fraction at the head of the low-pressure column and obtaining an oxygen-rich liquid in the sump of the low-pressure column, evaporating the oxygen-rich liquid at least partially by indirect heat exchange against the second airflow in an indirect heat exchanger, using at least a portion of the evaporated, oxygen-rich liquid as rising vapor in the low-pressure column, drawing off a different portion of the evaporated, oxygen-rich liquid and/or a portion of the oxygen-rich liquid as oxygen product(s), evaporating a first liquid intermediate fraction, which is obtained in the low-pressure column at a second intermediate site, at least partially by the indirect heat exchange for condensing the first nitrogen-rich fraction, and using at least a portion of the evaporated first intermediate fraction as rising vapor in the low-pressure column, wherein a portion of the evaporated first intermediate fraction and/or a fraction from the low-pressure column, obtained below the second intermediate site is/are obtained as a further oxygen product, the purity of which is lower than that of the oxygen product obtained in the form of an evaporated, oxygen-rich liquid and/or in the form of an oxygen-rich liquid from the sump of the low-pressure column, and wherein the indirect heat exchange between the first liquid intermediate fraction and the first nitrogen-rich fraction is carried out in a heat exchanger which is disposed outside of the low-pressure column.

18. A method according to claim 17, wherein the difference between the pressure of the second airflow during the indirect heat exchange for evaporating the oxygen-rich liquid and the pressure of the first airflow while it is being supplied to the medium-pressure column is at least 0.8 bar.

19. A method according to claim 17, wherein the low-pressure column is operated at a pressure only slightly above atmospheric, which is sufficient for removing the second, nitrogen-rich fraction, optionally after passage through one or several heat exchangers, essentially at atmospheric pressure from the process and/or using it as regenerating gas (**14*b***) in purification equipment.

20. A method according to claim 17, wherein the evaporation space of the indirect heat exchanger, in which the at least partial evaporation of the oxygen-rich liquid takes place, communicates with the lower region of the lower pressure column.

21. A method according to claim 17, wherein the pressure on a further airflow is relieved in a work-producing manner and that the airflow is introduced into the low-pressure column.

22. A method according to claim 21, wherein, energy, obtained by the work-producing relief of pressure of the further airflow, is used for compressing a third partial stream upstream from the work-producing relief of pressure.

23. A method according to claim 22, wherein the air used is purified in purification equipment and that the energy, obtained in the work-producing relief of pressure, is used to compress the air used upstream from the purification equipment.

24. A method according to claim 17, wherein a product flow is removed in liquid form from one of the columns, brought to pressure in the liquid state and subsequently evaporated.

25. A method for the low temperature fractionation of air, comprising:

forming a first airflow and a second airflow, passing the first airflow into a medium-pressure column, which is operated at above atmospheric pressure and in which an oxygen-enriched sump liquid and a first nitrogen-rich fraction are obtained, passing the sump liquid at a first intermediate site into a low-pressure column, which is operated under a pressure lower than that of the medium-pressure column, condensing the first nitrogen-rich fraction at least partially by indirect heat exchange, a nitrogen-rich liquid being produced, using a first portion of the nitrogen-rich liquid as backflow in the medium-pressure column, using a second portion of the nitrogen-rich liquid as backflow in the low-pressure column, obtaining a second nitrogen-rich fraction at the head of the low-pressure column and obtaining an oxygen-rich liquid in the sump of the low-pressure column, evaporating the oxygen-rich liquid at least partially by indirect heat exchange against the second airflow in an indirect heat exchanger, using at least a portion of the evaporated, oxygen-rich liquid as rising vapor in the low-pressure column, drawing off a different portion of the evaporated, oxygen-rich liquid and/or a portion of the oxygen-rich liquid as oxygen product(s), evaporating a first liquid intermediate fraction, which is obtained in the low-pressure column at a second intermediate site, at least partially by the indirect heat exchange for condensing the first nitrogen-rich fraction, and using at least a portion of the evaporated first intermediate fraction as rising vapor in the low-pressure column, wherein a portion of the evaporat and first intermediate fraction and/or a fraction from the low-pressure column, obtained below the second intermediate site is/are obtained as a further oxygen product, the purity of which is lower than that of the oxygen product obtained in the form of an evaporated, oxygen-rich liquid and/or in the form of an oxygen-rich liquid from the sump of the low-pressure column, and wherein a second liquid intermediate fraction is removed from the low pressure column at a third intermediate site and evaporated at least partially in indirect heat exchange, and wherein the evaporated second intermediate fraction is returned at least partially to the low-pressure column.

26. A method according to claim 25, wherein the indirect heat exchange for evaporating the second intermediate fraction is carried out against a third airflow, which is condensed at least partially at the same time.

27. A method according to claim 26, wherein an additional airflow is passed into an additional column, which is operated under a pressure, which lies between the pressure of the low-pressure column and the pressure of the medium-pressure column, the indirect heat exchange for evaporating the second intermediate fraction being carried out against the head fraction of the additional head column, which is condensed at least partially at the same time.

* * * * *